US006844826B2

(12) United States Patent
Yurimoto et al.

(10) Patent No.: US 6,844,826 B2
(45) Date of Patent: Jan. 18, 2005

(54) VEHICULAR ALARM SYSTEM AND APPARATUS

(75) Inventors: Masayuki Yurimoto, Aichi (JP); Akira Shinada, Tokyo (JP); Katsuhiko Nunokawa, Kanagawa (JP); Makoto Sasaki, Chiba (JP); Hiroaki Okajima, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/027,173

(22) Filed: Dec. 20, 2001

(65) Prior Publication Data

US 2002/0105418 A1 Aug. 8, 2002

(30) Foreign Application Priority Data

Dec. 22, 2000 (JP) ..... P2000-390854

(51) Int. Cl.[7] ..... G08G 1/123

(52) U.S. Cl. ..... 340/988; 340/903; 340/435; 701/301

(58) Field of Search ..... 340/988, 901, 340/902, 903, 904, 435, 436, 444, 460; 701/23, 301, 117; 180/274

(56) References Cited

U.S. PATENT DOCUMENTS 3,949,300 A * 4/1976 Sadler ..... 455/1
4,238,778 A * 12/1980 Ohsumi ..... 340/33
5,325,302 A * 6/1994 Izidon et al. ..... 700/301
5,450,057 A * 9/1995 Watanabe ..... 340/435
5,572,449 A * 11/1996 Tang et al. ..... 700/304
5,751,211 A * 5/1998 Shirai et al. ..... 340/435
5,926,118 A * 7/1999 Hayashida et al. .... 340/995.21
6,038,502 A * 3/2000 Sudo ..... 701/23
6,160,493 A * 12/2000 Smith ..... 340/902
6,211,778 B1 * 4/2001 Reeves ..... 340/436
6,252,520 B1 * 6/2001 Asami et al. ..... 340/903
6,326,903 B1 * 12/2001 Gross et al. ..... 340/988
6,445,308 B1 * 9/2002 Koike ..... 340/902
6,529,831 B1 * 3/2003 Smith et al. ..... 701/301

* cited by examiner

*Primary Examiner*—Phung Nguyen
(74) *Attorney, Agent, or Firm*—Jay H. Maioli

(57) ABSTRACT

A vehicle driver inputs an alarm signal from an operating unit. A control unit adds a current position of the vehicle detected by a navigation unit to the alarm signal and transmits the alarm signal with the current position from a transmitting and receiving unit to another vehicle. The transmitting and receiving unit receives a signal from another vehicle and supplies the signal to the control unit. The control unit calculates an intervehicular distance from current position data of the other vehicle included in the received signal and current position data of its own vehicle and outputs the alarm signal from speakers only when the intervehicular distance is within a predetermined value.

14 Claims, 8 Drawing Sheets

| ROAD TYPE \ SIGNAL TYPE | S1 | S2 |
|---|---|---|
| R1 | $r_{th11}$ | $r_{th12}$ |
| R2 | $r_{th21}$ | $r_{th22}$ |
| R3 | $r_{th31}$ | $r_{th32}$ |
| R4 | $r_{th41}$ | $r_{th42}$ |

VEHICULAR ALARM SYSTEM AND APPARATUS

BACKGROUND OF THE INVENTION

The present invention relates to an intervehicular alarm system and an intervehicular alarm apparatus, and particularly to a technique for transmitting and receiving alarm information between vehicles by using light, radio waves and the like.

Conventionally, techniques for transmitting alarm information to other vehicles by radio have been proposed. For example, Japanese Patent Laid-open No. Hei 1-202549 discloses a configuration in which a radio apparatus is included in a vehicle to allow alarm sound from another vehicle to be reliably perceived by a driver even when an audio apparatus is used in the vehicle, an alarm signal of a specific frequency is transmitted when an alarm switch is turned on, and alarm speakers are driven when the alarm signal is received from the outside.

However, when thus transmitting and receiving an alarm signal by radio, a vehicle other than the one for which the alarm signal is originally intended also receives the alarm signal as long as the vehicle is within reach of the radio, and the vehicle on receiving the alarm signal issues an alarm from speakers even though the transmitting vehicle is not present in the vicinity of the receiving vehicle. Thus, the driver of the receiving vehicle is confused.

Of course, it is conceivable that the reach of the radio may be limited to a certain range, but this may result in a case where an alarm does not reach a vehicle to which the alarm signal is originally intended to be transmitted.

In addition, even if the intended vehicle receives the alarm signal, it is difficult for the driver of the vehicle to determine the direction from which the alarm is issued when the alarm is simply outputted from speakers. The driver therefore needs to identify the vehicle that has issued the alarm by looking around when the alarm has been issued.

SUMMARY OF THE INVENTION

The present invention has been made in view of the problems with the related art, and it is accordingly an object of the present invention to provide a system and an apparatus that use radio techniques and make it possible to reliably notify an alarm to a vehicle that should be given the alarm.

In order to achieve the above object, according to an aspect of the present invention, there is provided an intervehicular alarm system for transmitting and receiving alarm information between a transmitting vehicle and a receiving vehicle, wherein the transmitting vehicle includes: detecting means for detecting position information of the transmitting vehicle; and transmitting means for transmitting the position information and alarm information; and the receiving vehicle includes: receiving means for receiving the position information and the alarm information transmitted from the transmitting vehicle; output means for outputting the alarm information; and control means for effecting control so that the alarm information is outputted from the output means when the control means determines on the basis of the position information that the transmitting vehicle is present within a predetermined distance from the receiving vehicle. By adding the position information to the alarm information for transmission, and outputting the alarm information only when the receiving vehicle determines by using the position information included in the received signal that the other vehicle which has transmitted the alarm signal is present within the predetermined distance from the receiving vehicle, it is possible to prevent output of an alarm in response to a signal transmitted from a vehicle irrelevant to the receiving vehicle, and thus output only a meaningful alarm.

Preferably, when the control means determines that the transmitting vehicle is present within the predetermined distance from the receiving vehicle, the control means changes a direction of output of the alarm information from the output means according to a direction of the transmitting vehicle with respect to the receiving vehicle. By outputting an alarm in a direction coinciding with the direction of the transmitting vehicle with respect to the receiving vehicle, it is possible for the vehicle driver of the receiving vehicle to quickly perceive the direction of the vehicle that has transmitted the alarm.

Preferably, when the control means determines that the transmitting vehicle is present within the predetermined distance from the receiving vehicle, the control means changes output level of the alarm information from the output means according to distance between the receiving vehicle and the transmitting vehicle. For example, by increasing the output level with decrease in the distance between the receiving vehicle and the transmitting vehicle, it is possible to notify the alarm to the vehicle driver more reliably.

Preferably, the transmitting means further transmits type information specifying a type of the alarm information; the receiving means receives the type information specifying the type of the alarm information; and the control means changes an output of the alarm information from the output means according to the specified type of the alarm information. The "alarms" in the present invention may include an alarm for arousing attention of surrounding vehicles and an expression of intention of a driver to be communicated to the surrounding vehicles. By transmitting and receiving the information specifying the type of the alarm and changing the output, it is possible to output a sound for arousing attention such as a horn sound and various other sounds such as a voice and thereby reliably communicate the intention to the surrounding vehicles. Thus, a smoother traffic flow can be realized.

Preferably, the type information specifying the type of the alarm information can specify at least a horn signal. In addition, preferably, the information specifying the type of the alarm information can specify voice data for expressing gratitude, voice data for indicating an intention to turn right or left, voice data for indicating an intention to overtake and the like.

In addition, preferably, the receiving vehicle further includes changing means for changing the predetermined distance according to the information specifying the alarm information. For example, for an alarm to which much attention needs to be aroused, the predetermined distance is increased to cover vehicles in a wide area, whereas for an alarm of relatively low importance, the predetermined distance is decreased to cover only adjacent vehicles.

Preferably, the changing means changes the predetermined distance according to a type of a road where the receiving vehicle is located.

Preferably, the transmitting means further transmits vehicle speed of the transmitting vehicle; the receiving means receives the vehicle speed from the transmitting means; and the control means changes output level of the alarm information according to the vehicle speed.

Furthermore, according to another aspect of the present invention, there is provided an alarm apparatus for use in an intervehicular alarm system. The apparatus includes: inputting means for inputting alarm information; position detecting means for detecting a current position of a vehicle of the apparatus; transmitting means for adding the current position to the alarm information and transmitting the resulting alarm information; receiving means for receiving a signal including position information and alarm information from another vehicle; calculating means for calculating a distance between the vehicle of the apparatus and the other vehicle on the basis of the current position and the position information; and output control means for outputting the alarm information when the output control means determines that the distance is within a predetermined distance.

Preferably, the calculating means calculates a direction of the other vehicle with respect to the vehicle of the apparatus, and the output control means changes a direction of output of the alarm information according to the calculated direction.

Also, preferably, the output control means changes output level of the alarm information according to the distance.

Also, preferably, in the apparatus, the inputting means inputs a type of the alarm information, the transmitting means further adds the type to the alarm information and transmits the resulting alarm information, the receiving means receives a signal including the type from the other vehicle, and the output control means changes an output of the alarm information according to the type.

In this case, the type of the alarm information preferably represents a horn signal, for example.

In addition, preferably, the output control means changes the predetermined distance for making determination according to the type of the alarm information.

The output control means in the apparatus can change the predetermined distance for making determination according to a type of a road where the vehicle of the apparatus is located.

Furthermore, in the apparatus, the transmitting means can further add vehicle speed of the vehicle of the apparatus to the alarm information and transmit the resulting alarm information, the receiving means can receive a signal including the vehicle speed from the other vehicle, and the output control means can change the predetermined distance for making determination according to the vehicle speed.

DETAILED DESCRIPTION OF THE PREFERRED EMBODIMENTS

Preferred embodiments of the present invention will hereinafter be described with reference to the drawings.

Figure 1:
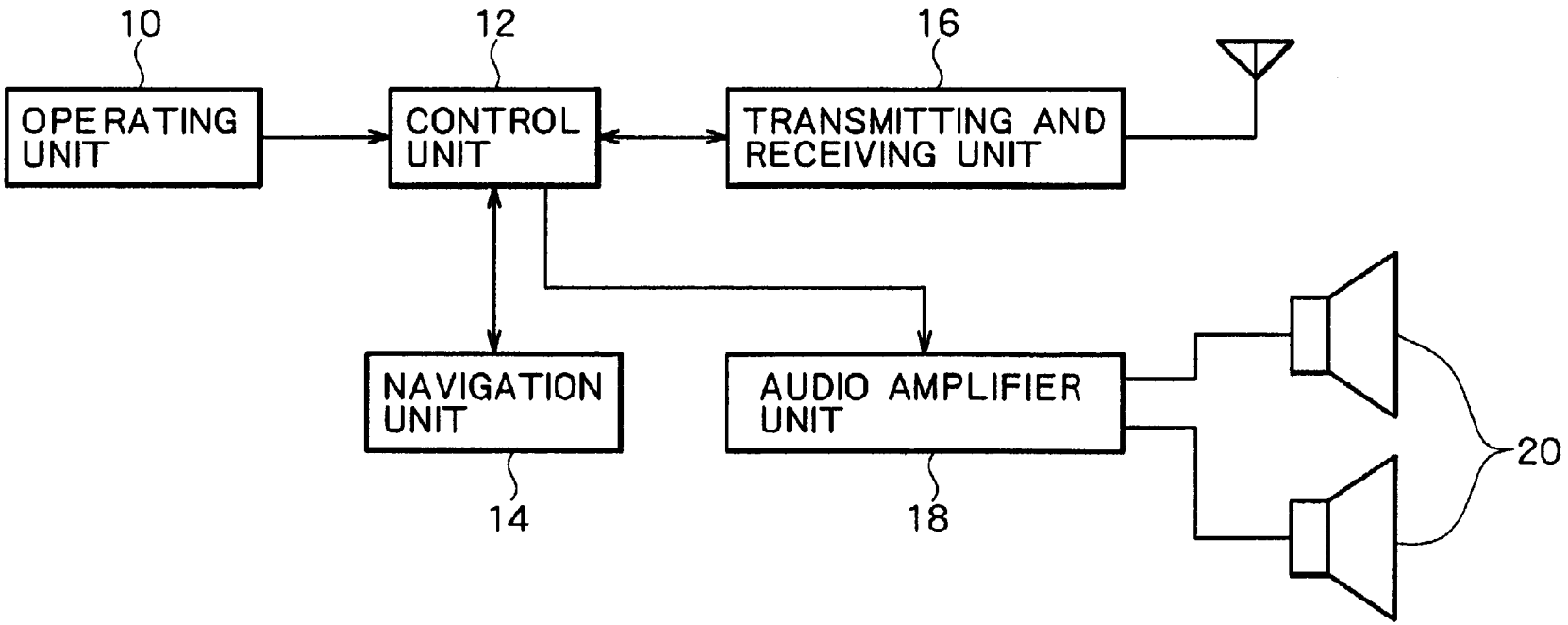
FIG. 1 is a configuration block diagram of an embodiment of the present invention.

FIG. 1 is a configuration block diagram of an alarm apparatus according to an embodiment of the present invention. The apparatus is included in each vehicle, and functions as a transmitter for transmitting an alarm signal to other vehicles and a receiver for receiving an alarm signal from another vehicle. An operating unit 10 is provided in the vicinity of a driver's seat, for example in the vicinity of an instrument panel or a steering wheel, and is used for the vehicle driver to input an alarm signal. The operating unit 10 may also serve as a related art horn switch or klaxon switch. An alarm signal inputted from the operating unit 10 is supplied to a control unit 12.

A navigation unit 14 performs a known navigation function; specifically, the navigation unit 14 has a function of detecting a current position of the vehicle, a function of map matching of the detected current position with map data stored in a memory unit, or a function of making a search for a route to a destination inputted by the vehicle driver. The map data can be stored on a recording medium such as CD-ROM (Compact Disc Read Only Memory) or DVD (Digital Versatile Disc). The current position of the vehicle can be detected by GPS (Global Positioning System), DGPS (Digital Global Positioning System), or a combination of a vehicle speed sensor and a direction sensor. Data of the current position of the vehicle detected by the navigation unit 14 is supplied to the control unit 12.

The control unit 12 is formed by a microcomputer. The control unit 12 adds the data of the current position of the vehicle supplied from the navigation unit 14 to the alarm signal supplied from the operating unit 10, and then supplies the result to a transmitting and receiving unit 16. The transmitting and receiving unit 16 transmits the supplied alarm signal with the current position data to vehicles around via an antenna. The alarm signal may be transmitted in the form of a radio wave of a specific frequency (for example 400 MHz) or in the form of light.

When an alarm signal with current position data is transmitted from another vehicle, on the other hand, the transmitting and receiving unit 16 receives the signal from the other vehicle and supplies the signal to the control unit 12. The control unit 12 compares the current position of its own vehicle supplied from the navigation unit 14 with the current position of the other vehicle included in the received signal. The control unit 12 determines that the alarm signal is transmitted from the other vehicle to its own vehicle when a predetermined condition is satisfied, and then outputs the alarm signal to an audio amplifier unit 18. The audio amplifier unit 18 amplifies the alarm signal to an appropriate level to output alarm sound from speakers 20. The condition for outputting the alarm signal will be described later.

Incidentally, it is desirable to provide a plurality of speakers 20 at least at four corners of the vehicle, that is, a front right FR, a front left FL, a rear right RR, and a rear left RL. By adjusting output levels of the plurality of speakers, the control unit 12 can output the alarm sound to the vehicle driver from an arbitrary direction. For example, in order to output the alarm sound from a front right direction as viewed from the vehicle driver, only the front right FR speaker of the four speakers 20 mounted in the vehicle may be driven. Techniques for disposing a sound source in a specific direction by using a plurality of speakers are known.

Figure 2:
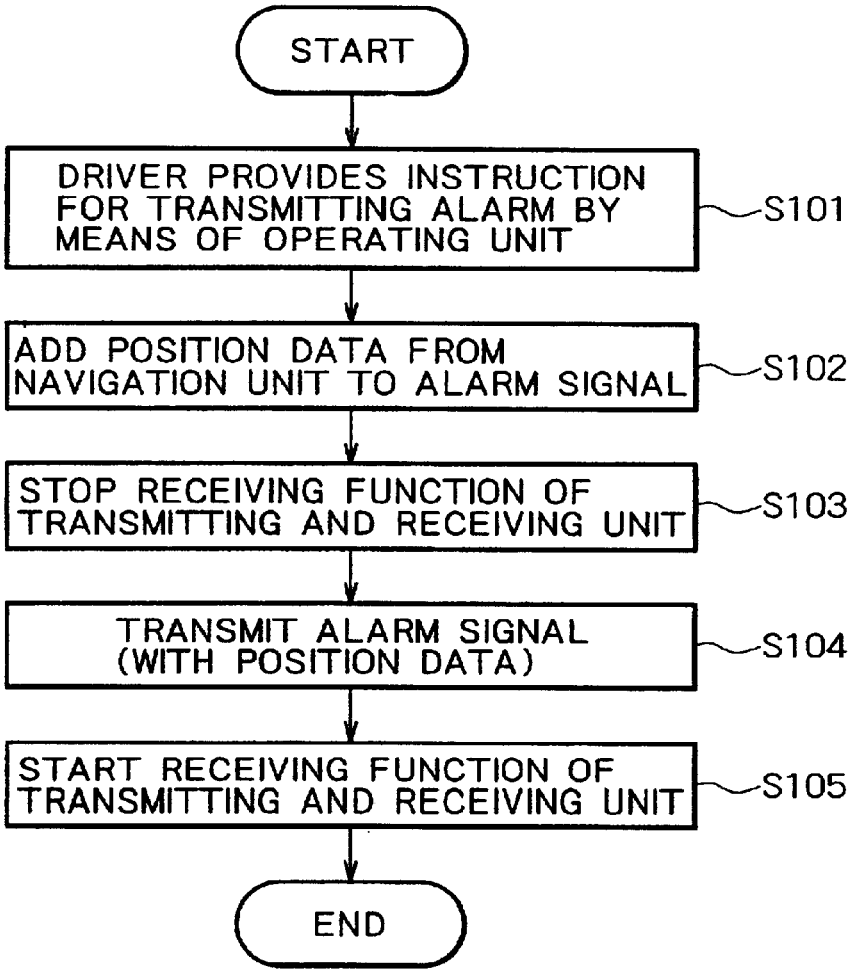
FIG. 2 is a flowchart of processing in transmission according to the embodiment.

FIG. 2 is a flowchart of processing in transmitting an alarm signal in the present embodiment. First, the vehicle driver operates the operating unit 10 to provide an instruction for transmitting an alarm signal (S101). As one mode, the vehicle driver operates a horn unit (klaxon unit) provided to the steering wheel, for example. The vehicle driver can thereby provide the instruction for transmitting an alarm signal within a range of normal operation without performing a special operation.

The alarm signal inputted from the operating unit 10 is supplied to the control unit 12. Then, the control unit 12 adds the current position data supplied from the navigation unit 14 to the supplied alarm signal (S102). The current position data may be three-dimensional or two-dimensional coordinates detected by GPS or DGPS, or may be position data on map data adjusted by map matching with the map data. The control unit 12 temporarily stops the receiving function of the transmitting and receiving unit 16 (S103), and then supplies the alarm signal with the current position data to the transmitting and receiving unit 16 to transmit the alarm signal with the current position data to the periphery of the vehicle (S104). The receiving function is temporarily stopped at the time of transmission in order to positively prevent the vehicle from receiving the alarm signal transmitted by the vehicle itself when all vehicles use signals of the same frequency. Of course, instead of temporarily stopping the receiving function, the alarm apparatus may be configured to add an ID (Identification) unique to the vehicle (which may be a coded vehicle number) or the like when transmitting an alarm signal so that when an ID included in a received signal coincides with the ID of the vehicle, the control unit 12 determines that the received signal is the signal transmitted by the vehicle itself and thereby ignores the received signal. After transmitting the alarm signal of the vehicle, the control unit 12 restarts the receiving function of the transmitting and receiving unit 16 (S105) to be ready to receive a signal from another vehicle.

Figure 3:
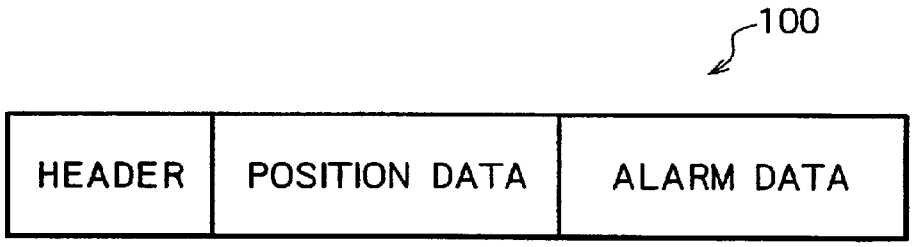
FIG. 3 is a diagram of assistance in explaining a format of an alarm signal.

FIG. 3 shows an example of a format of the alarm signal transmitted from the vehicle. The alarm signal 100 comprises a header portion followed by a position data portion and an alarm data portion. The position data portion includes the current position data of the vehicle as already described, and may be three-dimensional coordinates (x, y, z) or two-dimensional coordinates (x, y) on a road detected by GPS or DGPS, for example. The alarm data portion includes alarm signal data manipulated by the vehicle driver using the operating unit 10, and also includes data on length and interval manipulated by the vehicle driver. The alarm signal shown in FIG. 3 may be in a digital form.

Figure 4:
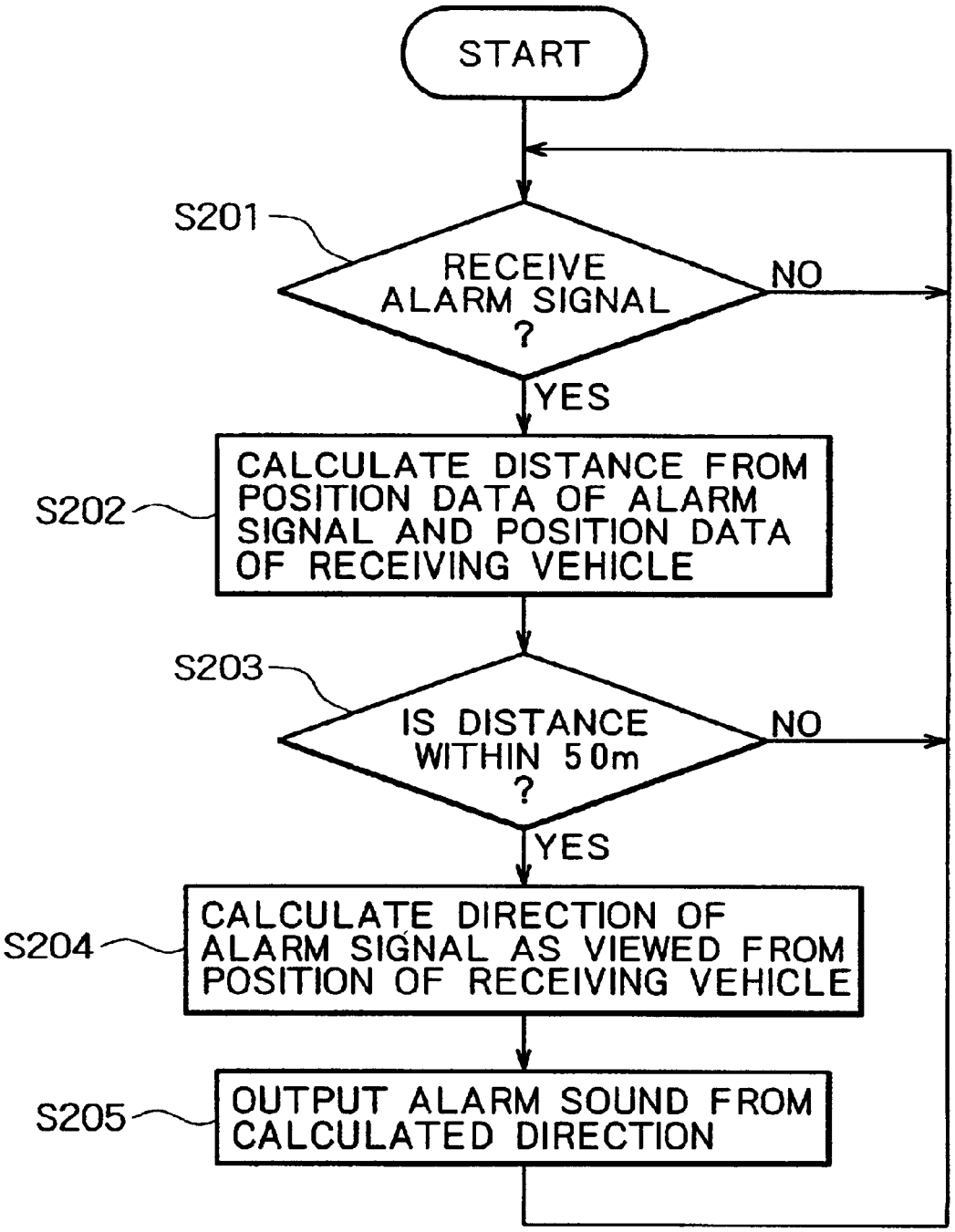
FIG. 4 is a flowchart of processing in reception according to the embodiment.

FIG. 4 is a flowchart of processing in receiving an alarm signal in the present embodiment. First, when the transmitting and receiving unit 16 receives a signal from another vehicle (S201), the transmitting and receiving unit 16 supplies the received signal to the control unit 12. The control unit 12 calculates a distance between its own vehicle and the other vehicle from the current position data of the other vehicle included in the received signal and the current position data detected by the navigation unit 14 of its own vehicle (S202). When it is assumed that the position of its own vehicle is (x0, y0) and the position of the other vehicle is (x1, y1), for example, the distance can be calculated as an absolute distance between the coordinates.

Figure 5:
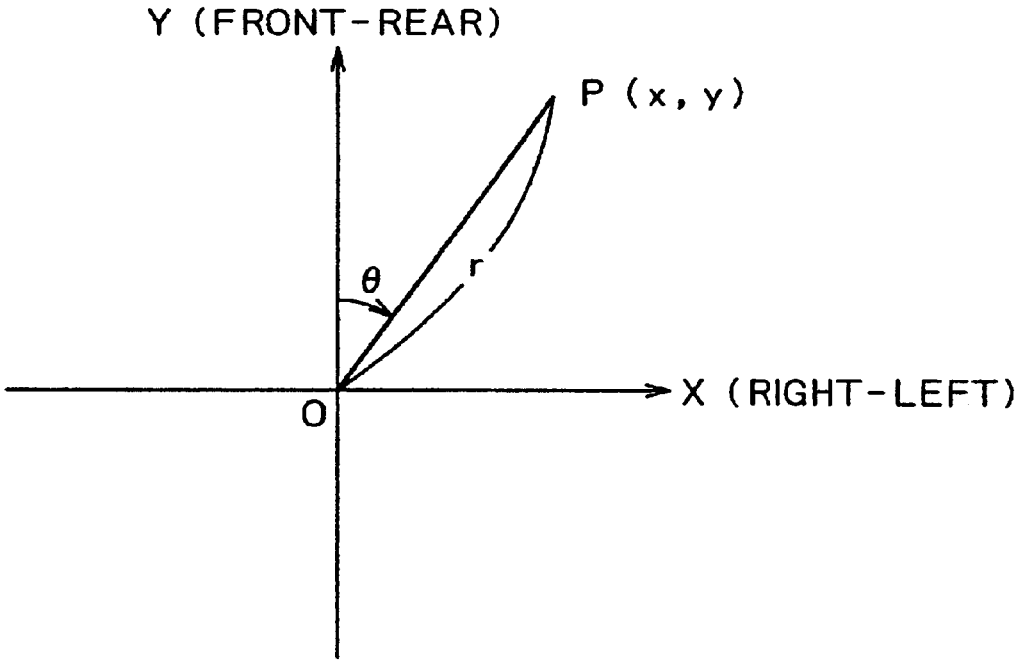
FIG. 5 is a diagram of assistance in explaining a distance between a receiving vehicle and a transmitting vehicle and a direction of the transmitting vehicle as viewed from the receiving vehicle.

After calculating the distance between its own vehicle and the other vehicle, the control unit 12 further determines whether the calculated distance is within a predetermined distance, for example 50 m (S203). This determination is made to ignore a signal transmitted from a vehicle considered irrelevant to its own vehicle. When the distance between its own vehicle and the other vehicle exceeds the predetermined distance, the control unit 12 determines that the received signal is an alarm signal transmitted to another vehicle, and thus performs no processing. On the other hand, when the distance between its own vehicle and the other vehicle is within the predetermined distance, the control unit 12 determines that the received signal is an alarm signal transmitted from the other vehicle to its own vehicle. The control unit 12 next calculates a direction of the alarm signal as viewed from the position of its own vehicle (S204). The direction can also be calculated from the current position of its own vehicle and the current position of the other vehicle. As shown in FIG. 5, when it is assumed that the current position of its own vehicle is O and the current position of the other vehicle is P, the distance r between its own vehicle and the other vehicle and the direction θ of the other vehicle with respect to the traveling direction of its own vehicle (Y-axis in the figure) can be calculated on the basis of principles of elementary geometry. After calculating the direction of the other vehicle as viewed from its own vehicle, that is, the other vehicle that has transmitted the alarm signal, the control unit 12 drives the audio amplifier unit 18 and the speakers 20 to thereby output alarm sound from a direction coinciding with the direction where the other vehicle is present (S205). For example, when the other vehicle is present at θ=0° in FIG. 5, that is, the other vehicle is present in the traveling direction of the signal receiving vehicle, the control unit 12 drives the front right FR and the front left FL speakers of the plurality of speakers 20 at the same level to output the alarm sound. When the other vehicle is present at θ=90°, that is, on the right side of the signal receiving vehicle, the control unit 12 drives the front right FR and the rear right RR speaker at the same level to output the alarm sound.

Thus, the present embodiment not only transmits and receives alarm signals by radio but also adds the current position of its own vehicle to an alarm signal for transmission, and the vehicle receiving an alarm signal selects the alarm signal for output from the speakers by considering its own current position and the current position of the other vehicle. Therefore, it is possible to positively prevent the output of alarm sound in response to an alarm signal transmitted from an irrelevant vehicle.

Also, the present embodiment calculates the direction of the other vehicle with respect to its own vehicle, and outputs alarm sound in a direction coinciding with the direction where the other vehicle is present. Therefore, the vehicle driver can readily perceive the direction of the vehicle that has transmitted the alarm sound, and can thereby respond to the alarm promptly.

It is to be noted that the present embodiment not only can process an alarm signal only when the distance between its own vehicle and the other vehicle is within the predetermined distance, but also can process an alarm signal only when the distance between its own vehicle and the other vehicle is within the predetermined distance and the direction of the other vehicle as viewed from its own vehicle is a predetermined direction. Specifically, when it is clear from the current position of its own vehicle detected by the navigation unit 14 and data on road structure and facilities on map data that no vehicle is present in a certain direction, it is desirable to process an alarm signal only when another vehicle is present in a direction other than that direction.

Figure 6:
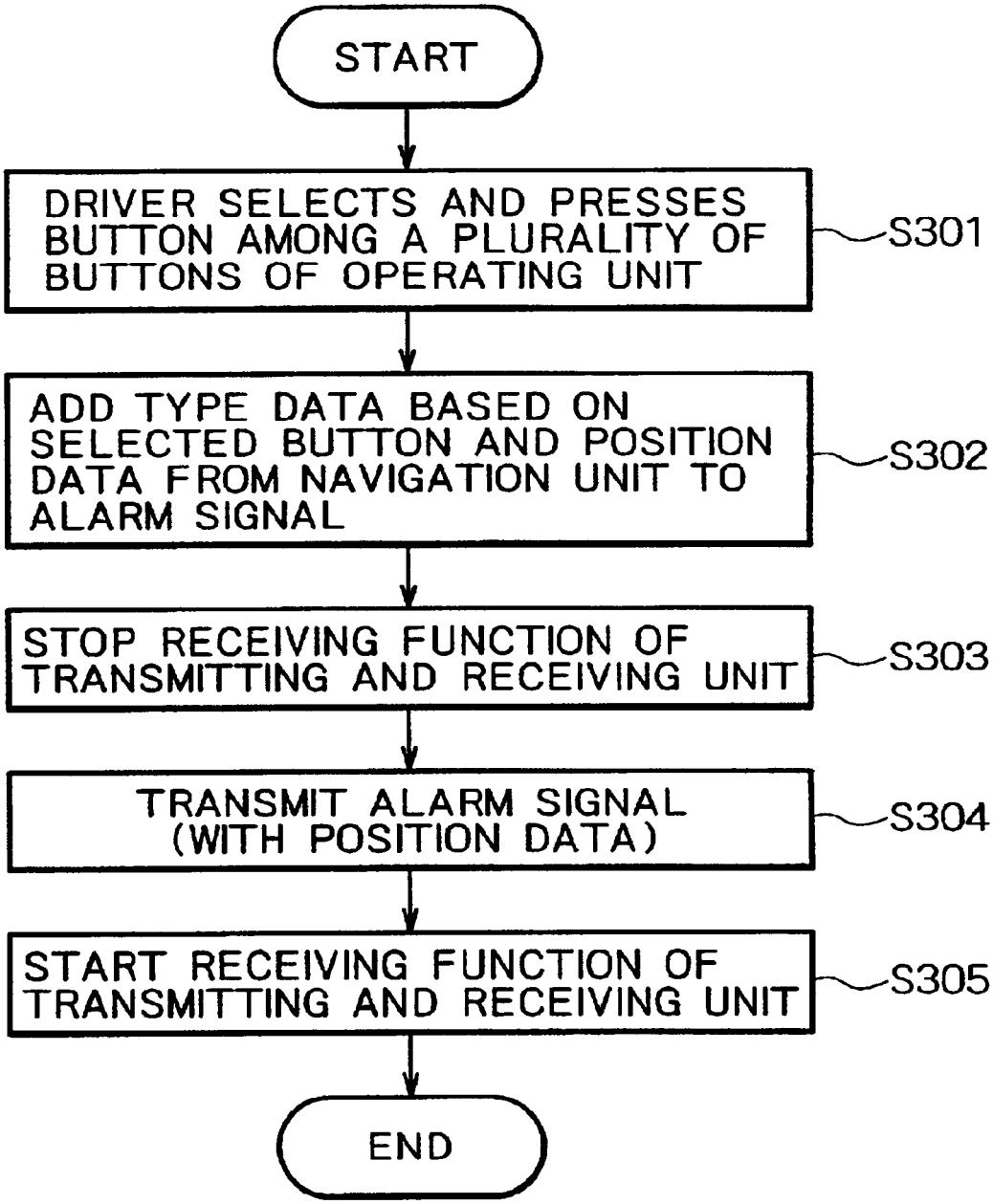
FIG. 6 is a flowchart of processing in transmission according to another embodiment.
Figure 7:
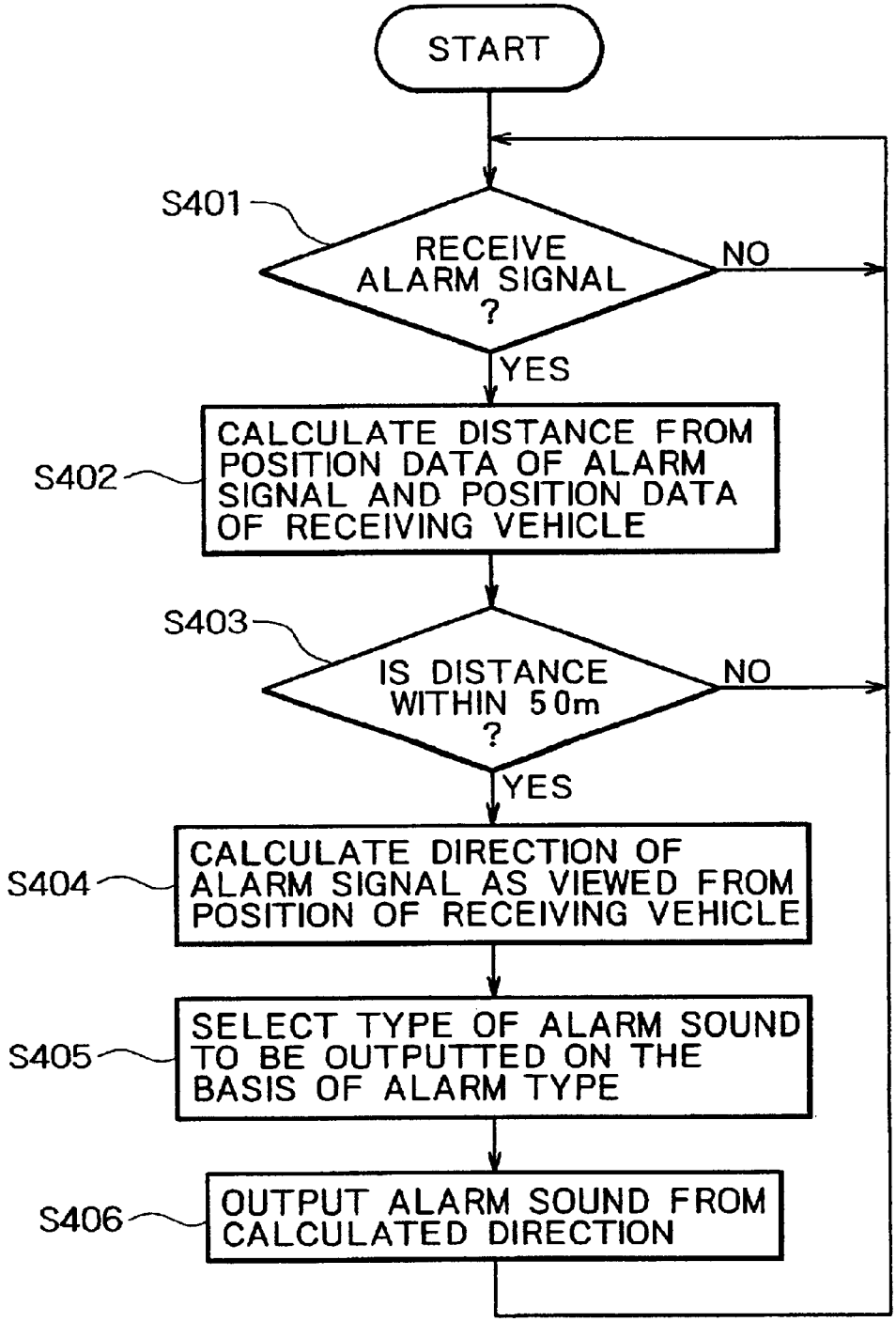
FIG. 7 is a flowchart of processing in reception according to the other embodiment.

FIG. 6 and FIG. 7 are flowcharts of processing in transmission and reception according to another embodiment. The present embodiment not only transmits and receives alarm signals, but also transmits and receives alarm signals with an alarm type added thereto. It is to be noted that alarms include not only horn sound (klaxon sound) but also voice data for indicating an intention of the vehicle driver.

First, in FIG. 6, the vehicle driver selects a type of an alarm signal from a plurality of buttons provided on an operating unit 10 to thereby input an alarm signal (S301). A control unit 12 adds to the alarm signal type data on the basis of the selected button and current position data detected from a navigation unit 14 (S302). The control unit 12 temporarily stops the receiving function of a transmitting and receiving unit 16 (S303). The control unit 12 transmits the alarm signal to the periphery of the vehicle (S304). After transmitting the alarm signal, the control unit 12 restarts the receiving function of the transmitting and receiving unit 16 to be ready to receive a signal from another vehicle (S305).

In FIG. 7, when receiving an alarm signal with current position data and type data added thereto from another vehicle (S401), the control unit 12 calculates a distance between its own vehicle and the other vehicle from the current position data of the other vehicle included in the received signal and the current position data of its own vehicle detected by the navigation unit 14 (S402). Then, the control unit 12 determines whether the distance is within a predetermined distance (S403). When the distance between its own vehicle and the other vehicle exceeds the predetermined distance, the control unit 12 performs no processing as in the foregoing embodiment. On the other hand, when the distance between its own vehicle and the other vehicle is within the predetermined distance, the control unit 12 determines that the received signal is an alarm signal transmitted to its own vehicle. The control unit 12 next calculates a direction of the other vehicle as viewed from its own vehicle, that is, the other vehicle that has transmitted the alarm signal (S404). After calculating the direction of the other vehicle as viewed from its own vehicle, the control unit 12 further identifies a type of alarm sound by the type data included in the received signal (S405). The alarm sound is then outputted from the direction calculated at S404 (S406). As a specific example of the present embodiment, there is a case where the driver of the other vehicle desires to transmit data for expressing gratitude when the other vehicle has cut in in front of the receiving vehicle. In this case, the driver selects data for expressing gratitude as an alarm type. Then, a voice such as "Thank you" is outputted from speakers of the receiving vehicle. This eliminates the need for the driver of the other vehicle to communicate the intention of the driver to vehicles around by blinking hazard warning lamps after cutting in.

Figures 8, 9:
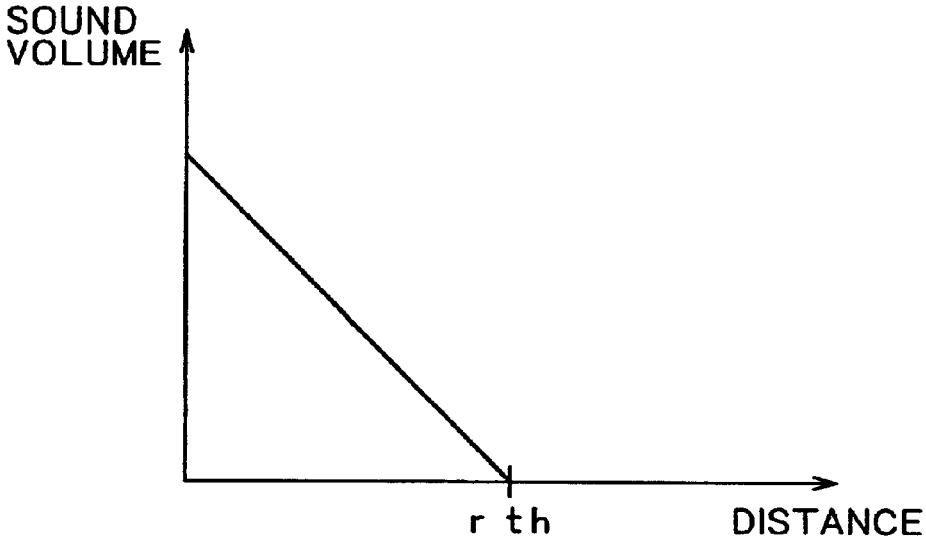
FIG. 8 is a graph showing a relation between sound volume and a distance between a receiving vehicle and a transmitting vehicle.
FIG. 9 is a diagram of assistance in explaining threshold distance changed according to a type of alarm signal and a type of road.

While the embodiments of the present invention have been described above, the present invention is not limited to the above embodiments and is susceptible of various changes. For example, when outputting horn sound as an alarm, it is also preferable to change volume of alarm sound (output level) according to distance between a receiving vehicle and a transmitting vehicle. As shown in FIG. 8, for example, with a configuration for outputting alarm sound when the distance is within a predetermined distance rth (ignoring an alarm signal when the distance exceeds the predetermined distance is equivalent to reducing the alarm sound to zero when the distance exceeds the predetermined distance), the control unit 12 drives the audio amplifier unit 18 so as to increase the sound volume with decrease in the distance between its own vehicle and the other vehicle, for example. This makes it possible to achieve consistency of actual relation in distance with sound volume and thus properly give an alarm to a vehicle driver. Incidentally, while a relation between the distance and the sound volume is defined linearly in FIG. 8, the relation may of course be defined non-linearly.

It is also preferable to change a threshold distance rth for determining whether to output an alarm according to a type of alarm sound or a type of road where the vehicle is traveling. FIG. 9 schematically shows a table stored in a memory of the control unit 12 when changing the threshold distance according to the type of alarm sound and the type of road. For example, when the type of road traveled by its own vehicle is R1 and the type of alarm signal received from another vehicle is S1, the control unit 12 sets the threshold distance for determination processing at rth 11. When the alarm type is the same but the road type is different, for example R2, the control unit 12 sets the threshold distance at rth 21. The road type may be an expressway, an ordinary road, a city street or the like, and it is preferable to set the threshold distance rth of an expressway greater than that of an ordinary road. Alternatively, it is preferable to set the threshold distance rth for horn sound greater than that of alarm data for expressing gratitude. The type of road traveled by the vehicle can be detected by matching the current position with map data in the navigation unit 14.

Figure 10:
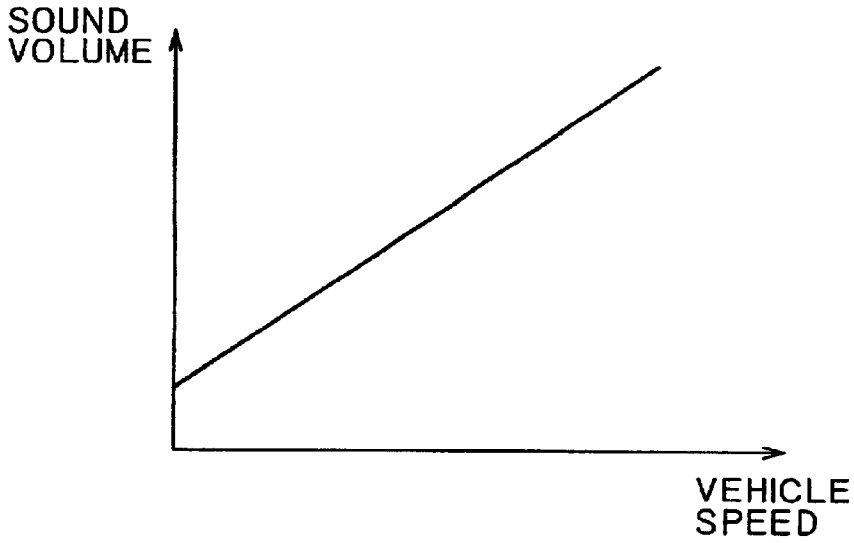
FIG. 10 is a graph showing a relation between vehicle speed and sound volume.
Figure 11:
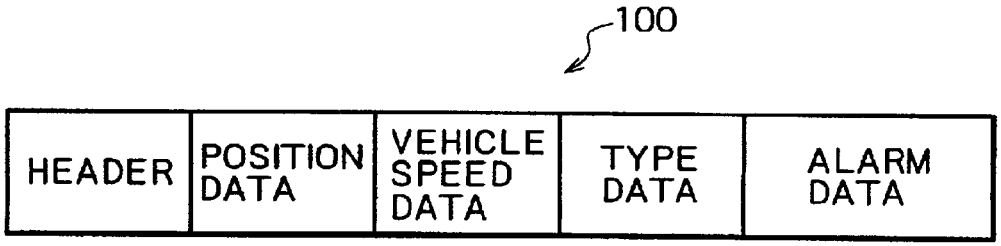
FIG. 11 is a diagram of assistance in explaining a format of an alarm signal according to the other embodiment.

Moreover, the control unit 12 may add vehicle speed of its own vehicle in conjunction with current position data and alarm type data to an alarm signal for transmission to the periphery of the vehicle, and change the sound volume on the basis of vehicle speed data included in a signal received from another vehicle. FIG. 10 shows an example of thus changing the output sound volume according to the vehicle speed, in which the output sound volume is increased as the vehicle speed of the other vehicle that has transmitted an alarm signal becomes higher. FIG. 11 shows an example of format of an alarm signal 100 having current position data, alarm type data, and vehicle speed data added thereto.

Furthermore, the control unit 12 may add data specifying a type of vehicle (ordinary size or large size) to an alarm signal for transmission to the periphery of the vehicle, and change the threshold distance rth or the sound volume on the basis of the type of vehicle included in a signal received from another vehicle. For example, when the vehicle transmitting an alarm signal is a large-size vehicle, the threshold distance rth is set greater, or the sound volume is made greater than when the vehicle is an ordinary-size vehicle.

Furthermore, while in the foregoing embodiments, an alarm signal is transmitted and an alarm signal from another vehicle is received by a single apparatus, the transmitter and the receiver may be mounted separately from each other.

As described above, according to the present invention, alarm signals are transmitted and received by radio and only a signal from another vehicle present within a predetermined distance is processed. Therefore, an alarm signal received from an irrelevant vehicle is not outputted, whereby an alarm can be reliably outputted to the vehicle driver. In addition, the alarm is outputted from a direction coinciding with the direction of the other vehicle as viewed from the receiving vehicle. Therefore, the vehicle driver can readily perceive the direction of the alarm signal, and can thereby make appropriate response to the alarm signal promptly.

What is claimed is:

1. An intervehicular alarm system for transmitting and receiving alarm information between a transmitting vehicle and a receiving vehicle, wherein said transmitting vehicle includes:

detecting means for detecting position information of said transmitting vehicle;

an operating unit for operation by a user of the transmitting vehicle for specifying from a plurality of types of alarms a type of alarm information; and transmitting means for transmitting said position information and said type of alarm information; and said receiving vehicle includes:

receiving means for receiving said position information and said type of alarm information transmitted from said transmitting vehicle;

means for determining a current position of the receiving vehicle;

output means for outputting one of a plurality of alarm types to a user of the receiving vehicle; and control means for performing control of outputting said alarm information including means for calculating a distance between the receiving vehicle and the transmitting vehicle based on the current position of the receiving vehicle and said transmitted position information and for determining that said transmitting vehicle is within a predetermined distance less than an effective range of said transmitting means from said receiving vehicle based on said calculated distance, wherein said receiving means receives said type of said alarm information; and said control means selects one of said plurality of alarm types of said output means according to said type of said alarm information specified by said operating unit of said transmitting vehicle.

2. The intervehicular alarm system as claimed in claim 1, wherein when said control means determines that said transmitting vehicle is present within said predetermined distance said control means changes a direction of output of said alarm information from said output means according to a direction of said transmitting vehicle with respect to said receiving vehicle.

3. An intervehicular alarm system as claimed in claim 1, wherein when said control means determines that said transmitting vehicle is present within said predetermined distance said control means changes output level of said alarm information from said output means according to a distance between said receiving vehicle and said transmitting vehicle.

4. The intervehicular alarm system as claimed in claim 1, wherein said plurality of types of alarm information specifying said type of alarm includes a horn signal and a voice sound.

5. The intervehicular alarm system as claimed in claim 1, wherein said receiving vehicle further includes changing means for changing said predetermined distance according to said information specifying said alarm information.

6. The intervehicular alarm system as claimed in claim 5, wherein said changing means changes said predetermined distance according to a type of a road where said receiving vehicle is located.

7. The intervehicular alarm system as claimed in claim 1, wherein said transmitting means further transmits a vehicle speed of said transmitting vehicle;

said receiving means receives said vehicle speed from said transmitting means; and said control means changes an output level of said alarm information according to said vehicle speed.

8. An alarm apparatus for use in an intervehicular alarm system, said apparatus comprising:

inputting means for operation by a user of a first vehicle and for selecting an alarm type from a plurality of different alarm types and producing alarm type information;

position detecting means for detecting a current position of said first vehicle of said apparatus;

transmitting means for adding said current position to said alarm type information and transmitting resulting current position and alarm type information;

receiving means arranged in a second vehicle for receiving a signal including said current position information and said alarm type information from said first vehicle;

position detecting means for detecting a current position of said second vehicle;

calculating means for calculating a distance between said first vehicle of said apparatus and said second vehicle based on said current position of said second vehicle and said position information corresponding to said current position of said first vehicle;

means for sounding an alarm arranged in said second vehicle, in which a type of the alarm is selected from different types of alarms based on the alarm type information, and output control means for outputting said alarm type information to said means for sounding an alarm where said output control means determines that said calculated distance is within a predetermined distance less than an effective range of said transmitting means, wherein said output control means changes the type of alarm from said alarm sounding means based on said alarm type information from said first vehicle.

9. The alarm apparatus as claimed in claim 8, wherein said calculating means calculates a direction of said second vehicle with respect to said first vehicle of said apparatus; and said output control means changes a direction of output of said alarm information according to said calculated direction.

10. The alarm apparatus as claimed in claim 8, wherein said output control means changes an output level of said alarm information according to said distance.

11. The alarm apparatus as claimed in claim 8, wherein said different types of alarms include a horn signal and a voice sound.

12. The alarm apparatus as claimed in claim 8, wherein said output control means changes said predetermined distance for determining according to said type of said alarm information.

13. The alarm apparatus as claimd in claim 8, wherein said output control means changes said predetermined distance for determining according to a type of a road where said first vehicle of said apparatus is located.

14. The alarm apparatus as claimed in claim 8, wherein said transmitting means adds a vehicle speed of said first vehicle of said apparatus to said alarm information and transmits resulting alarm information;

said receiving means receives a signal including said vehicle speed from said second vehicle; and said output control means changes said predetermined distance for determining according to said vehicle speed.

* * * * *